United States Patent [19]

Bottemiller

[11] 4,068,888

[45] Jan. 17, 1978

[54] RECLINER CHAIR

[75] Inventor: Merton M. Bottemiller, Wadena, Minn.

[73] Assignee: Homecrest Industries, Inc., Wadena, Minn.

[21] Appl. No.: 647,134

[22] Filed: Jan. 7, 1976

[51] Int. Cl.[2] ..... A47C 1/02

[52] U.S. Cl. ..... 297/317

[58] Field of Search ..... 297/319, 326, 349, 317, 297/320, 322, 68, 85; 248/389, 325

[56] References Cited

U.S. PATENT DOCUMENTS

| | | | |
|---|---|---|---|
| 1,117,979 | 11/1914 | Cromer | 297/319 |
| 1,570,436 | 1/1926 | Dawson | 297/304 |
| 2,263,450 | 11/1941 | Anderson | 297/317 |
| 2,400,588 | 5/1946 | McArthur | 297/317 |
| 2,512,353 | 6/1950 | Magaldino et al. | 297/317 |
| 2,712,346 | 6/1955 | Sprinkle | 297/343 |
| 2,916,084 | 12/1959 | Bottemiller et al. | 297/326 X |
| 3,252,734 | 5/1966 | Berlin | 297/317 |
| 3,302,970 | 2/1967 | Rizzato | 248/279 |
| 3,603,641 | 9/1971 | Knabusch | 297/DIG. 7 |
| 3,672,721 | 6/1972 | Williams | 297/304 |
| 3,934,932 | 1/1976 | Ekornes | 297/320 |
| 3,947,069 | 3/1976 | Lusch | 297/317 |

*Primary Examiner*—James T. McCall
*Attorney, Agent, or Firm*—Frederick E. Lange

[57] ABSTRACT

An adjustable recliner chair of the type in which the chair back is pivoted at an intermediate point to a supporting frame and the chair seat is pivotally supported at its rear by the chair back so that as the chair back is tilted rearwardly, the chair seat moves forwardly, the chair seat having adjacent its front an inclined cam surface which slidably engages a support member secured to said supporting frame so that as the chair seat moves forwardly the front of it moves upwardly. The support member and inclined cam surface are held together by an adjustable friction connection which is adjusted to vary the frictional effect tending to hold the chair seat in any adjusted position. The supporting frame may be mounted on a base through coil springs which enable the chair to be rocked. The adjustable friction connection, in such case, is adjusted to ensure that the frictional effect is sufficient to maintain the chair seat and chair back in their adjusted position as the coil springs are flexed during the rocking operation. The chair may also have a swivel connection between the supporting frame and base to enable the chair to be swivelled.

7 Claims, 7 Drawing Figures

RECLINER CHAIR

BACKGROUND OF THE INVENTION

The present invention is concerned with the type of recliner chair in which the chair back is pivoted to a supporting frame along a pivot line somewhat above the bottom of the chair back and in which the chair seat is pivotally secured at its back to the chair back and is supported at its front by supporting members secured to the supporting frame. Such chairs have the characteristic that when the chairback is tilted rearwardly, the chair seat moves forward. Various arrangements have been provided for ensuring that as the back is tilted rearwardly and the chair seat moves forward, the front of the chair moves upwardly. This results in a much more comfortable reclining position. Many of these prior arrangements, however, are quite complicated, employing linkage mechanisms in some cases or elaborate cam constructions in others. Furthermore, in some cases, the arrangements have either provided for a limited number of positions in which the chair seat can be adjusted or have resulted in an arrangement in which the chair seat can be moved too easily out of the desired adjusted position, so as to result in accidental displacement of the chair from the desired position.

SUMMARY OF THE INVENTION

The present invention is concerned with a reclining chair of the type discussed above in which a very simple means is provided for maintaining the chair in any selected reclining position. Broadly, this is accomplished by providing a cam member on the underside of the seat adjacent the front thereof, this cam member having an inclined lower wall which slopes downwardly from front to rear and engages a support member secured to the supporting frame of the chair. In this way, as the chair back is tilted rearwardly, the front of the chair seat automatically moves upwardly as the chair seat moves forwardly.

I may further provide means for maintaining the inclined surface of the cam member and the support member in engagement with each other by providing the inclined lower wall of the cam member with a slot of predetermined length and a rod member associated with the support member which extends through this slot, the amount of relative movement of the chair seat and support member being limited by the length of the slot.

I may also provide friction means associated with the rod member so as to tend to cause the chair to remain in any position to which it is adjusted. This friction means may include an adjustable spring for varying the extent of the frictional effect produced by the friction means.

The chair supporting frame may be yieldably secured to the chair base to allow rocking of the chair. In such case, the adjustable friction means is adjustable to exert sufficient frictional effect between the support member and the cam member to prevent relative shifting of these two members as the chair is rocked.

Where the reclining chair is yieldably secured to the base, the means for yieldably securing the frame to the base may comprise two coil springs each of which has one end secured to the supporting frame and the other end supported by the base.

I also contemplate having the ends of the coil springs secured to the base fastened thereto through a plate which is mounted on the base by a swivel apparatus so that the chair is not only capable of being reclined and rocked but also of being swivelled with respect to the base.

The friction means may include a friction plate and an adjustable spring means for adjusting the force exerted upon this friction plate.

The frictional means may include a layer of frictional material engaging the inclined lower wall and supported by a member which is slightly rockable with respect to the support member to accommodate the change in angular position of the inclined lower wall with respect to the support member as the positions of the chair back and chair seat are shifted.

Further objects and features of the invention will be apparent from a consideration of the accompanying specification, claims and drawing.

DESCRIPTION OF THE PREFERRED EMBODIMENT

Figure 1:
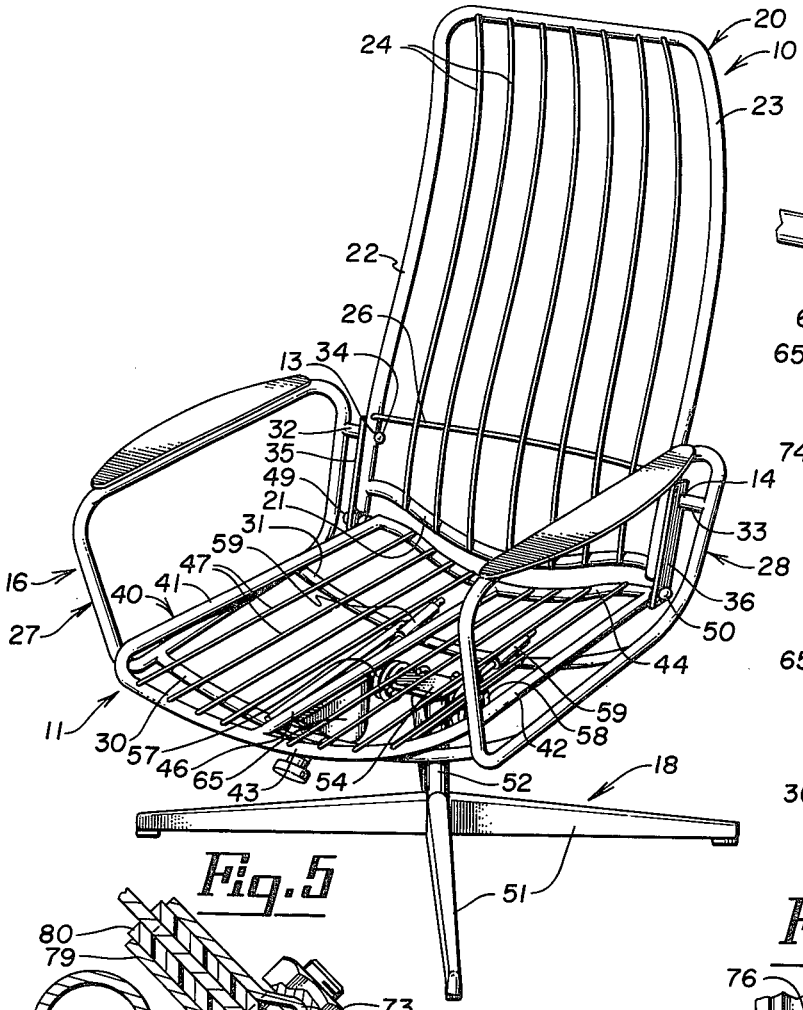
FIG. 1 is a perspective view of my improved reclining chair.

Referring to FIG. 1, the chair of my invention is shown in perspective. Broadly, the chair comprises a chair back 10 which has pivotally secured thereto a chair seat 11. The chair back 10 is pivotally secured by pivotal connections 13 and 14 to a supporting frame 16. The supporting frame 16 is in turn mounted on a chair base 18.

Referring first to the chair back 10, it will be noted that this comprises a tubular member 20 which is curved to conform to the desired outline of the chair, the member 20 having two side portions 22 and 21. The lower ends of side portions 22 and 23 of tubular member 10 are joined by a tubular member 21 which is secured at its ends to tubular member 20 by welding or any other suitable manner. A plurality of rods 24, extending generally parallel to side portions 22 and 23, are secured at their opposite ends to the cross tubular member 21 and to the main tubular member 20, the rods being curved to conform with the desired curvature of the chair back. A cross rod 26 is secured, as by welding, at its opposite ends to the side portions 21 and 22 of tubular member 20 and is welded to the various rods 24. The result is a relatively simple chair back frame which has the desired curvature to fit the back of a typical person.

Referring now to the supporting frame 16, this comprises two side portions 27 and 28 which are each formed of a tubular member curved to the desired modified O-shaped configuration. The two side portions 27 and 28 are joined together by a plurality of cross tubular members 30 and 31 which are welded at their ends to the two side sections 27 and 28. Tubular members 30 and 31 are formed to accommodate the chair seat 11 which will presently be described. Referring to the side portions 27 and 28, the substantially vertical rear portion of section 27 has a short tubular member 32 welded thereto and extending inwardly. A similar short tubular member 33 is secured to the rear upstanding portion of side portion 28. These short tubular sections form stub members for supporting the back 10. The stub members may be tapped to receive pivot pins such as pivot pin 34 which extend through the downwardly extending side portion 22 of tubular member 20 and into the stub member 32. A similar pivot pin (not shown) extends through the downwardly extending arm 23 of tubular member 20 and into stub member 33. Secured to the lower portions of arms 22 and 23 are a pair of plates 35 and 36. These plates are rigidly secured to the downwardly extending arms 22 and 23 of tubular member 20 and act as extensions thereof. The plates 35 and 36 are provided to enable a convenient pivotal connection of the bottom portion of the chair to the chair seat 11.

Referring to the chair seat 11, this again is formed of a tubular member 40 which is bent in a generally rectangular form to provide two side portions 41 and 42, a front portion 43 and a rear portion 44. Extending between the front portion 43 and the rear portion 44 and welded thereto is a center tubular rod 46. It is of course understood, as will be evident from the drawing, that the front and rear portions of 43 and 44 are curved to provide a seat of comfortable configuration. Also extending between the front and rear portions 43 and secured thereto as by welding are a plurality of rods 47. The rear ends of the two side portions 41 and 42 are pivotally secured to the plates 35 and 36 which, as previously discussed, are rigidly secured to the downwardly extending arms 22 and 23 of the tubular portion 20 of the chair back. The pivotal connections between the side portions 41 and 42 of the chair seat and the plates 35 and 36 are designated by the reference numerals 49 and 50 respectively.

It will be seen from the construction described above that the back 10 and the chair seat 11 are pivotally connected together. The back is pivotally supported by the stub members 32 and 33 which are rigidly secured to the side portions 27 and 28 of the supporting frame 16. The pivotal axis on which the back 10 is pivoted extends through the centers of the stub members 32 and 33. The chair back and chair seat are pivotally connected together along a pivotal axis which extends through the pivotal connections 49 and 50. It will be noticed that the pivotal axis between the back of the chair and the chair seat is substantially lower than between the back of the chair and the supporting frame 16. Thus, if the chair back 10 is rocked rearwardly about its pivotal axis which, as previously explained, lies along the axis of the stub members 32 and 33, the chair seat 11 will tend to move forwardly. It is the purpose of this invention to provide an arrangement whereby when such forward movement of the chair seat takes place, the front portion of the chair is raised with respect to the rear portion.

Before getting into the specific structure for raising the forward portion of the chair, the means by which the supporting frame 16 is supported by the base 18 will be described briefly. Base 18 comprises legs 51 which are disposed at right angles to each other and which are secured to a tubular base member 52. A plate 54 is swivelly mounted in the tubular base member 52. The plate 54 has a stub shaft secured thereto (not shown) which extends into the tubular housing 52. A washer 55 of low friction material such as Nylon is interposed between the plate 54 and the top tubular base member 52 so that the plate 54 readily turns with respect to the base 18. As will be presently explained, this provides a swivel connection between the main portion of the chair and the base 18.

Figure 2:
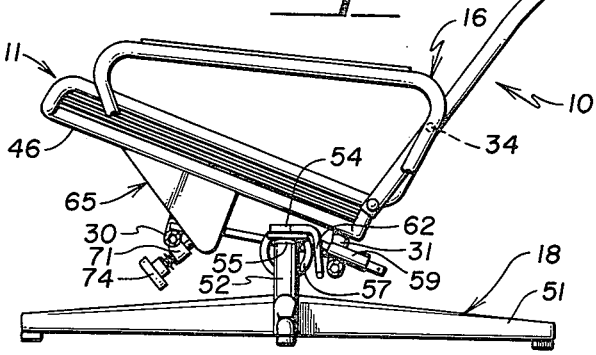
FIG. 2 is a side elevational view of the chair with portions broken away and portions in section, the chair being in a reclining position.

The plate 54, as best shown in FIG. 1, is rectangular in character. Secured to the plate 54 are the ends of two coils springs 57 and 58. Each coil spring may be two or three turns and the corresponding ends of the two springs 57 and 58 are rigidly secured to plate 54 as by welding as best shown in FIG. 2. The opposite ends of the coil springs extend through sleeves 59 which are rigidly secured to the cross tubular member 31 at a distance apart from each other corresponding to the spacing of the ends of springs 57 and 58. The ends of springs 57 and 58 are retained in sleeves 59 at the desired longitudinal position with respect to sleeves 59 by any suitable retaining means such as set screws. It will be obvious that the further sleeves 59 are towards the outer ends of the springs 57 and 58 the more readily the springs 57 and 58 can be flexed. Similarly, as sleeves 59 are moved inwardly towards the coiled portions of springs 57 and 58, more effort is required to rock.

Inasmuch as the sleeves 59 are rigidly secured to the cross tubular member 31 of the supporting frame 16, it will be clear that supporting frame 16 is supported by the rearwardly extending arms of springs 57 and 58. The inner ends of springs 57 and 58 are in turn secured to plate 54 which is swivelly mounted in the base 18, as previously described. It will be obvious that if the occupant of the chair leans back on the back 10, the entire upper portion of the chair including the back 10, the seat 11, and the supporting frame 16 will tilt by reason of the tensioning of spring members 57 and 58. The chair thus provides a rocking action by reason of the two springs 57 and 58. In this respect, the action is very similar to that of the chair covered by U.S. Pat. No. 2,916,084 of which I am a joint inventor.

A U-shaped yoke member 62 is also secured to the plate member 54 as shown in FIG. 1. This U-shaped yoke member 62 acts as a stop to limit the rocking motion. It will be obvious that if the chair is rocked sufficiently, the tubular bar 31 will engage the stop member 62 to limit the backward rocking motion.

Figure 4:
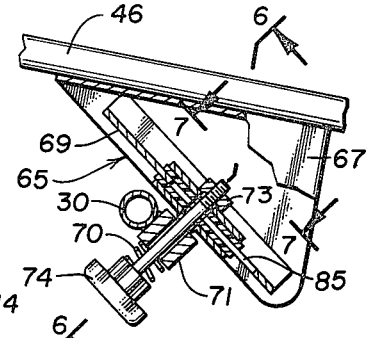
FIG. 4 is a detail view partly in section showing the means for moving the chair seat upwardly as the chair back is tilted and the means for retaining the chair in any adjusted position.
Figure 6:
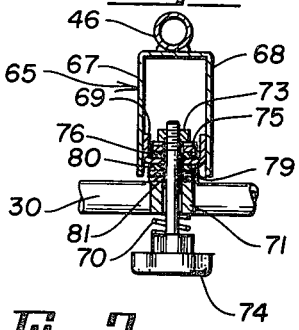
FIG. 6 is a fragmentary sectional view, the section being taken along line 6—6 of FIG. 4.

Referring now to the mechanism by which the front of the chair is raised whenever the back is tilted back about the pivot points 34, it will be noted that there is secured to the underside of the chair seat 11 a triangular shaped cam member 65. This cam shaped member is hollow, and as best shown in FIGS. 4 and 6, is rigidly secured to the underside of tubular rod 46 which, as will be noted from FIG. 1, extends between the forward and rear portions of the chair frame 40, being rigidly secured thereto as by welding. As best shown in FIG. 6, the member 65 is in the form of an inverted U-shaped bracket having two triangular side walls 67 and 68. Securely fastened within the member 65 between the walls 67 and 68 is a U-shaped member 69, the side walls of which are secured to the side walls 67 and 68 of cam member 65 as by rivets or welding. It will be noted that the bottom wall of the U-shaped bracket is spaced a substantial distance from the bottom wall of the bracket 65. The purpose of this will be discussed later.

It will be recalled that the supporting frame has two cross tubular members 30 and 31, as shown in FIG. 1.

Secured to tubular member 30 at approximately the midpoint thereof is a sleeve 71. Sleeve 71 has an aperture therethrough through which extends a rod 72 threaded at its outer end. The rod 72 cooperates with a nut 73 which, as will be explained later, is retained against rotational movement. The rod 72 has a knob 74 secured thereto. Interposed between the sleeve 71 and the knob 74 is a spring 70 which serves to bias outwardly the rod 72 and the nut 73 secured thereto.

Interposed between the nut 73 and the base of the U-shaped bracket 69 which is secured to triangular bracket 65, is a metal plate 75 and a sheet 76 of frictional material such as polyethylene. The sheet of polyethylene 76 is forced into engagement with the bottom of the U-shaped channel 69 by reason of the biasing force exerted by spring 70. It will be noted that the plate 75 has a rib 78 which fits into a correspondingly shaped recess in nut 73 to prevent the nut 73 from rotating. This means that whenever the knob 74 is rotated, the nut 73 will remain stationary and the rod 72 will be threaded in or out depending upon the direction of rotation of knob 74. Obviously, when the knob 74 is rotated so as to move the threaded rod 72 inwardly, the pressure exerted by spring 70 upon nut 73 the plate 75 and the sheet 76 of plastic material in increased.

Figure 5:
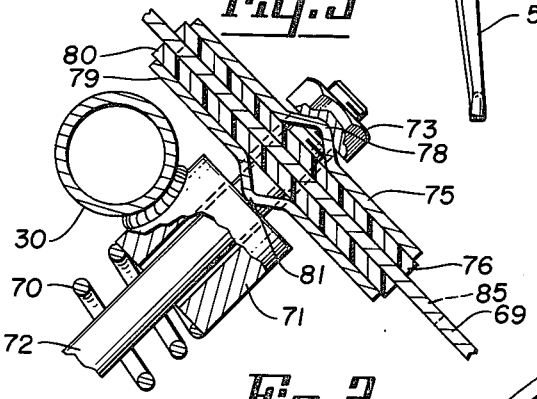
FIG. 5 is a view showing a portion of the apparatus of FIG. 4 but on a larger scale.

Interposed between sleeve 71 and the underside of the bottom wall of channel member 69 are a metal plate 79 and another sheet 50 of friction material such as polyethylene. It will be noted that plate 79 and sheet 80 are located within the side walls 67 and 68 so that the side walls act as a guide for plate 79 and sheet 80. As will be evident from FIGS. 4 and 5, the diameter of the apertures through plates 75 and 79 and sheets 76 and 80, through which bolt 72 extends, is much greater than the diameter of the bolt so that the plates 74 and 79 and sheets 76 and 80 can rock with respect to bolt 72. Plate 79 is provided with rib 81 to provide for rocking of the plate 79 and the associated plate 75 and the associated members with respect to the bolt 72 and sleeve 71. This will also provide for relative rocking movement between cam member 65 and the entire assembly secured to tubular bar 30. This slight rocking movement is necessary because, as will be readily apparent, as there is shifting in the position of the chair seat 11, the chair seat not only moves backward or forward but it also tends to change its angular position. Hence, it is necessary to provide for rocking action between the cam 65 and the supporting frame including support tube 30.

Figure 7:
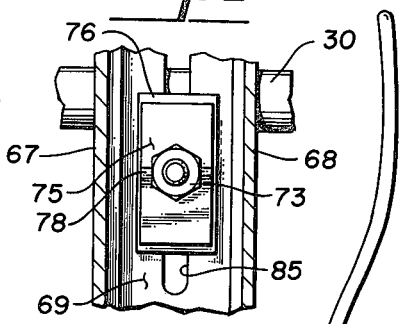
FIG. 7 is a fragmentary sectional view, the section being taken along line 7—7 of FIG. 4.

As best shown in FIGS. 4 and 7, the bottom plate of the channel shaped member 69 is provided with a slot 85 through which the bolt 72 extends. If enough force is exerted upon the chair seat shifting it back and forth, the channel member 69 will shift with respect to the bolt 72. As this takes place, the area of contact of the bottom of the channel 69 with the friction surfaces 76 and 80 will shift. Due to the fact that the bottom of cam 65 and the bottom of channel member 69 is inclined in such a direction that it slopes downwardly away from the chair, it will be obvious that any shifting of the chair seat 11 forwardly will cause the front of the chair to rise. Similarly, any shifting of the chair seat 11 backwardly towards the rear will cause the front of the chair seat to lower.

Figure 3:
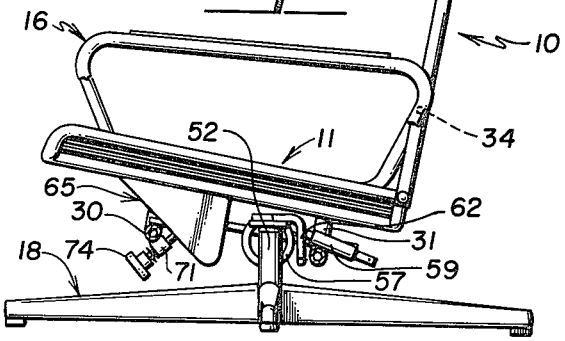
FIG. 3 is a view similar to FIG. 2 but with the chair in an upright position.

In FIGS. 2 and 3, the chair is shown in two different positions of inclination. It will be noted that in FIG. 2, the chair seat 11 has been moved as far forward as possible. In this position, the bolt 72 engages the end of the bolt 85 and the chair can be inclined no further. In FIG. 3, the chair has been moved to a more upright position. In this position, the bolt 72 is presumably either at or near the opposite end of slot 85 so as to limit the movement of the chair to a more upright position.

It will be obvious that the ease with which the inclination of the chair can be changed is dependent upon the frictional force exerted by frictional layers 76 and 80 upon opposite sides of the bottom wall of channel shaped member 69. This can, of course, be varied by adjustment of the knob 74. One very important aspect of the adjustment feature is connected with the use of springs 57 and 58 to provide a rocking motion for the chair. If the channel 69 moves too freely with respect to rod 72 and the plates 75 and 79 and the friction members 76 and 80, the force exerted when the chair is rocked in the normal manner might tend to cause a shifting of the chair seat and a change in the inclination of the back when the supporting member 16 is in any given position. This would obviously be undesirable. The knob 74 is accordingly adjusted until the friction exerted by friction members 76 and 80 is sufficiently great that the rocking movement of the chair provided for by the springs 57 and 58 will not cause a shifting in the inclination of the chair with respect to the supporting frame 16.

It will be understood that when in use, the back 10 and the seat 11 will be covered by any suitable pad (not shown) and when so covered, due to the curvature of the various members constituting the frame, as discussed above, the chair will comfortably conform with the normal body and will permit ready rocking and swivelling of the chair. At any time when it is desired to shift the angular position of the chair, all that it is necessary to do is to lean back (if the chair is in its normal upright position), forcing the back 10 rearwardly and the seat 11 forwardly. This will cause the chair to shift towards the position shown in FIG. 2. The amount of such shifting which takes place is dependent upon the extent to which the back is pushed rearwardly by the occupant. When the occupant wishes to resume the normal position, all that it is necessary to do is to sit upright and force the chair seat 11 towards the rear. This will force the chair back upwardly. When the chair seat is moved forwardly to the reclining position shown in FIG. 2, the cam member 65 is effective to automatically raise the front of the chair. When the seat is forced back to the position shown in FIG. 3, the cam member forces the front of the chair seat back down. It is normally not necessary to manipulate the knob 74, this knob being initially adjusted to suit the convenience and comfort of the user and to insure that the frictional force exerted will be sufficient to enable the chair to be rocked about the springs without a shifting of the angle of inclination.

It will be readily seen that the arrangement described above provides for ready shifting of the angle of inclination of the chair seat as the chair back is shifted in position. In all positions, the chair will provide a maximum degree of comfort. In any position of inclination of the chair back, it is still possible to rock or swivel the chair. Because of the fact that the springs 57 and 58 are relatively close to the surface of seat 11, the chair is relatively stable even if the chair is rocked backwardly when it has been adjusted to the maximum reclining position. Because of this, it is not necessary to provide as great a range of adjustment of the inclination of the back as would otherwise be desirable. Furthermore, it will be noted that I have accomplished this with an extremely simple construction which can be readily formed of sheet metal and tubular and rod stock.

While I have shown a specific embodiment of my invention for purposes of illustration, it is to be understood that the scope of the invention is limited solely by that of the appended claims.

I claim:

1. An adjustable recliner chair comprising a base, a chair supporting frame secured to and supported by said base, a chair back pivotally supported from said frame about a first pivotal axis substantially above the bottom of said back, a chair seat pivotally secured to the rear thereof to said chair back along a second pivotal axis substantially below said first pivotal axis, and a cam member secured to the underside of said seat adjacent the front thereof with an inclined lower wall in the form of a plate sloping downwardly from front to rear and having a slot of predetermined length therethrough extending longitudinally of said plate, said supporting frame having a support member extending beneath said inclined lower wall of said cam member in adjustable engagement therewith so that as said chair back is tilted back, the chair seat moves forwardly and the front portion thereof moves upwardly due to shifting of the area of engagement of the inclined wall of said cam member with said support member, a friction member engaging said plate, said support member having a rod member extending through said slot and through said friction member generally transverse to said plate, the amount of movement of said chair seat relative to said supporting frame being limited by the engagement of said rod member with the opposite ends of said slot, and said rod member having means associated therewith for holding said friction member in yieldable frictional engagement with said plate.

2. The recliner chair of claim 1 in which said support member of said supporting frame extends transversely across said chair beneath said inclined lower wall.

3. The recliner chair of claim 1 in which said means for holding said friction member in frictional engagement with said plate includes an adjustable spring for varying the extent of the frictional effect produced by said friction member.

4. An adjustable recliner chair comprising a base, a chair supporting frame, yieldable means secured to said base and said supporting frame for yieldably supporting said supporting frame on said base for yieldable rocking movement of said frame about said base, a chair back pivotally supported from said frame about a first pivotal axis substantially above the bottom of said back, a chair seat pivotally secured to the rear thereof to said chair back along a second pivotal axis substantially below said first pivotal axis, and a cam member secured to the underside of said seat adjacent the front thereof with an inclined lower wall sloping downwardly from front to rear, said supporting frame having a support member extending beneath said inclined lower wall of said cam member in adjustable engagement therewith so that, for any position of said chair supporting frame, as said chair back is tilted back, the chair seat moves forwardly and the front portion thereof moves upwardly to change the angular relationship of said chair back and chair seat due to shifting of the area of engagement of the inclined wall of said cam member with said support member, a friction member supported by said support member and engaging said lower wall of said cam member, yieldable means also carried by said support member for urging said friction member into yieldable frictional engagement with said lower wall, and adjusting means for adjusting the force exerted by said yieldable means on said friction member to ensure sufficient frictional effect on said lower wall to prevent shifting of the angular relationship of said chair seat and chair back as said chair is yieldably rocked by rocking of said supporting frame about said base without preventing such change in said angular relationship when desired by the chair occupant.

5. The recliner chair of claim 4 in which the yieldable means secured to the base and said supporting frame comprises two coil springs each of which has one end secured to said supporting frame and the other end supported by said base.

6. The recliner chair of claim 5 in which said other end of such coil spring is secured to a plate mounted on said base by a swivel apparatus so that said chair is not only capable of being reclined and rocked but also of being swivelled with respect to said base.

7. The recliner chair of claim 1 in which said rod member is mounted on said supporting member through a connection providing for limited rocking movement of said rod with respect to said support member so that the rod and friction member associated therewith can accomodate for the change in angular position of said inclined lower wall with respect to said support member as the positions of said chair back and chair seat are shifted.

* * * * *